US006241084B1

(12) United States Patent
Gyr

(10) Patent No.: US 6,241,084 B1
(45) Date of Patent: Jun. 5, 2001

(54) PACKAGE AND METHOD OF DISPLAYING SAME

(76) Inventor: John D. Gyr, 1034 Michigan Ave., Benzonia, MI (US) 49616

( * ) Notice: Subject to any disclaimer, the term of this patent is extended or adjusted under 35 U.S.C. 154(b) by 0 days.

(21) Appl. No.: 09/527,603

(22) Filed: Mar. 17, 2000

(51) Int. Cl.[7] ..... B65D 85/00
(52) U.S. Cl. ..... 206/278; 206/457
(58) Field of Search ..... 206/278, 292, 206/457, 232, 387.1, 778, 450, 494

(56) References Cited

U.S. PATENT DOCUMENTS 3,354,576 * 11/1967 Gralnick ..... 206/457
3,631,975 * 1/1972 Leibowitz ..... 206/450
4,852,739 * 8/1989 Franco ..... 206/387.1
5,248,037 * 9/1993 Kornberg et al. ..... 206/457
5,718,331 * 2/1998 Smith ..... 206/292
5,813,538 9/1998 Kaufman ..... 206/457
6,021,626 2/2000 Goodman ..... 53/438
6,126,000 * 10/2000 Tung ..... 206/278

* cited by examiner

*Primary Examiner*—Jim Foster
(74) *Attorney, Agent, or Firm*—Charles M. Kaplan

(57) ABSTRACT

Fabric articles such as clothing are compressed into compact rectangular prisms that approximate the size and shape of selected products, such as books and video tapes. A package is formed when each of the compacted prisms is enclosed in a decorative and protective overlay that has printing on its visible surfaces that simulates visible surfaces of the selected product. A number of the packages are supported in side by side contact with each other on a horizontal surface in the same manner in which the simulated product is commonly displayed for sale.

26 Claims, 7 Drawing Sheets

PACKAGE AND METHOD OF DISPLAYING SAME

BACKGROUND OF THE INVENTION

This invention relates to the packaging and displaying of fabric articles, and more particularly to packages of clothing articles that resemble books or video tapes.

OBJECTIVES OF THE INVENTION

Accordingly, it is an object of this invention to provide improved packages of fabric articles and improved methods of displaying and selling such packages.

Another object is to provide a packaged clothing article that looks like a book and can be displayed and sold like a book.

Another object is to protect fabric clothing articles by completely or substantially enclosing such articles in a protective overlay.

An additional object is to provide a packaged clothing article that looks like a video cassette and can be displayed and sold like a video cassette.

Another object is to provide improved methods of displaying compressed clothing packages.

A further object is to provide packages of fabric articles that are durable, economical, pleasing in appearance, easy to handle, ship and display, and which do not possess defects found in similar prior art packages.

Other objects and advantages of the packages and methods incorporating this invention will be found in the specification and claims and the scope of the invention will be set forth in the claims.

DESCRIPTION OF THE INVENTION

Figure 1:
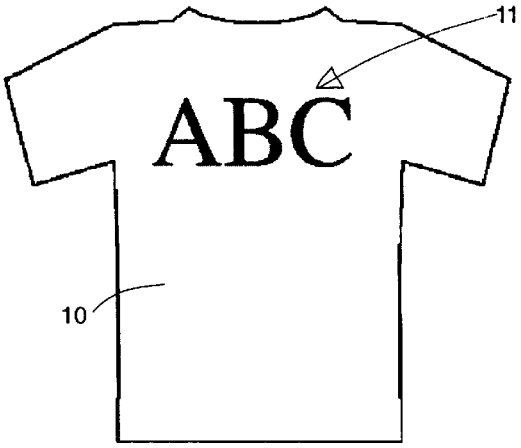
FIG. 1 is a schematic perspective view of a t-shirt.
Figure 2:
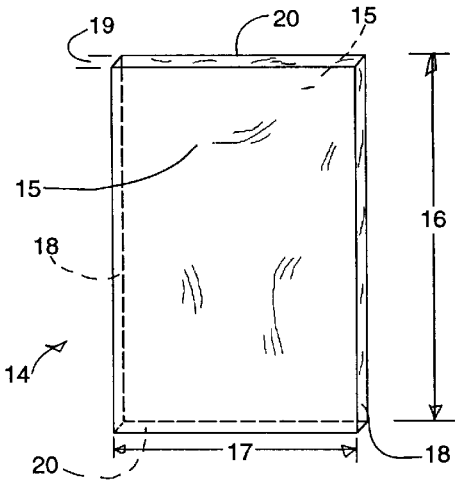
FIG. 2 is a schematic perspective view of a compressed t-shirt.
Figure 3:
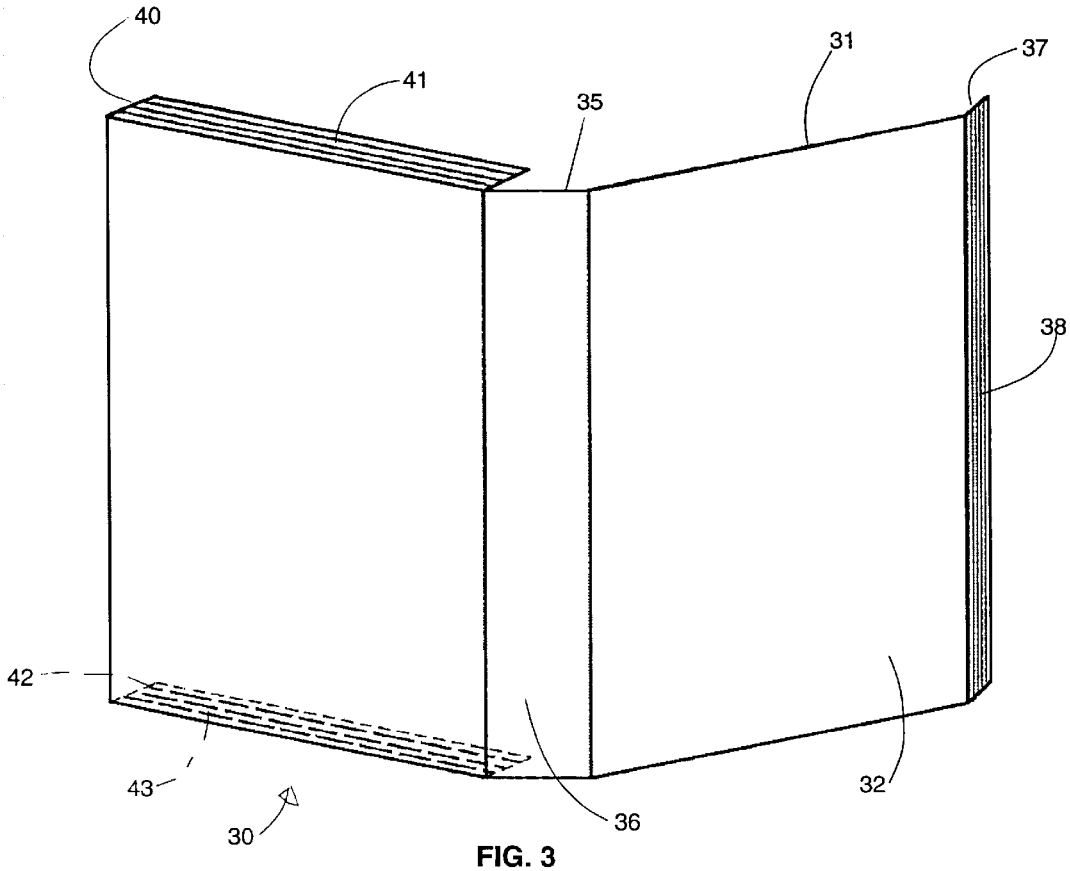
FIG. 3 is a schematic perspective view of the overlay from an embodiment of the invention.
Figure 4:
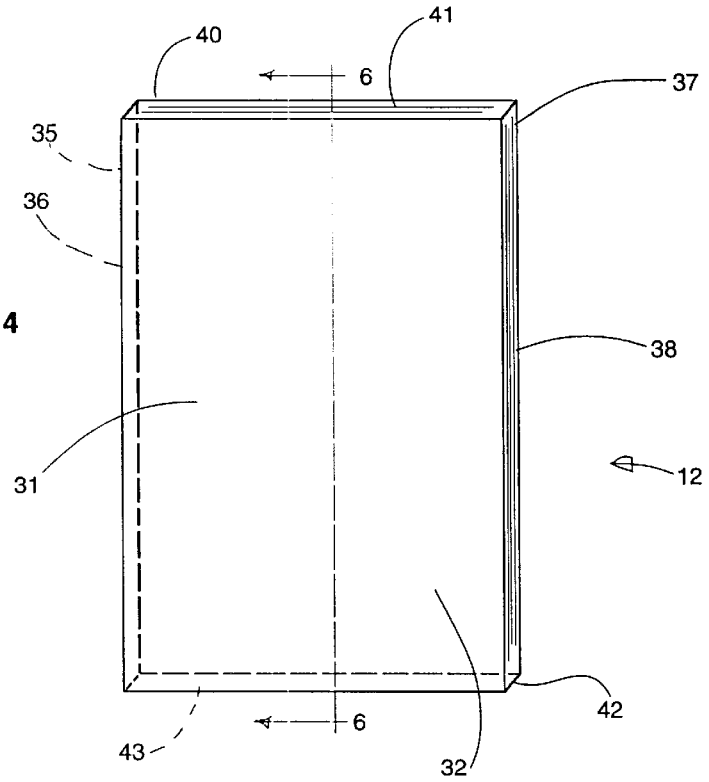
FIG. 4 is a schematic perspective front view of the embodiment from FIG. 3.
Figure 5:
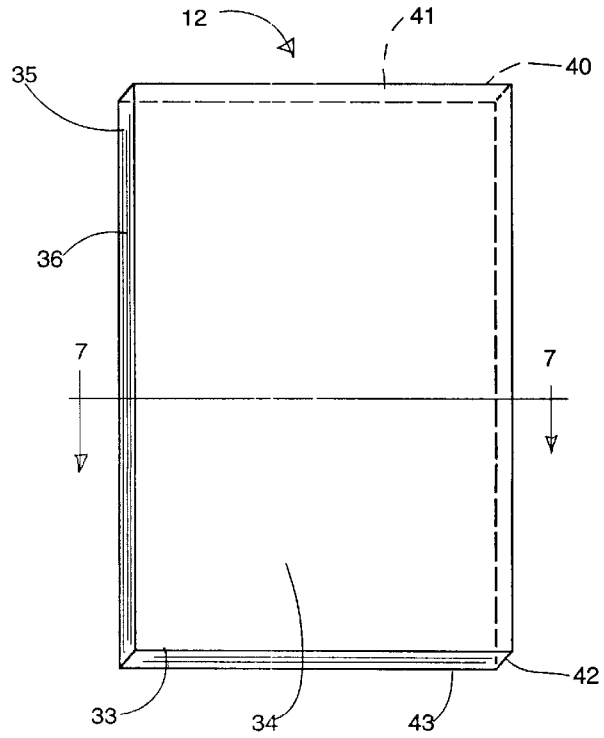
FIG. 5 is a schematic perspective rear view of the embodiment from FIG. 3.
Figure 6:
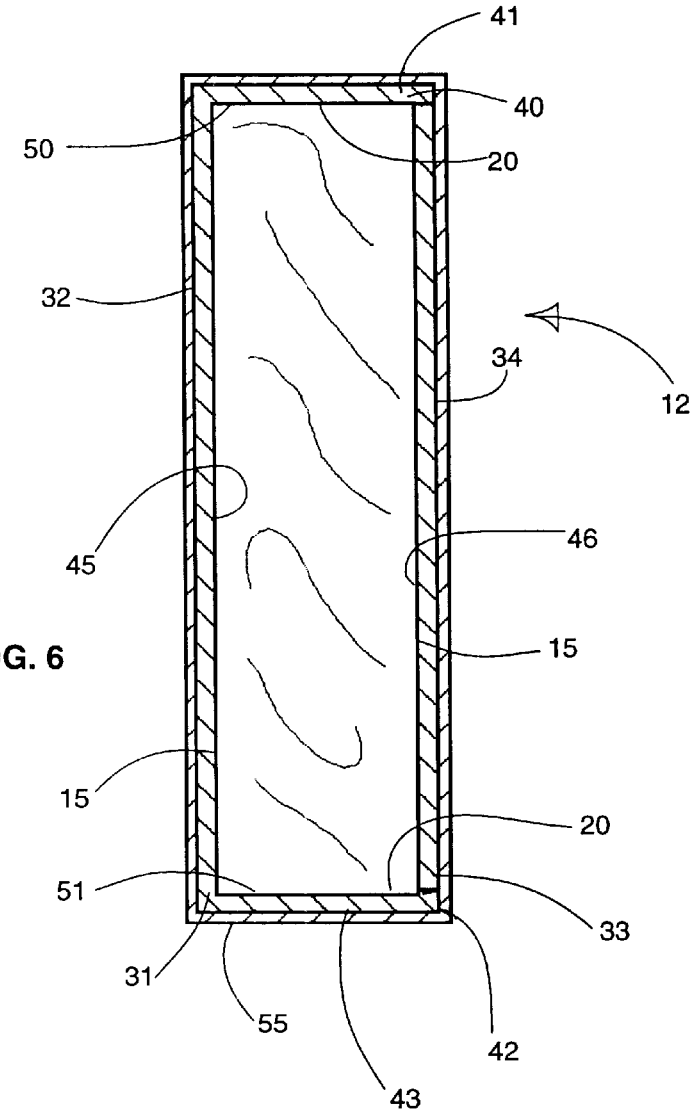
FIG. 6 is an enlarged cross sectional view taken along the line 6—6 in FIG. 4.
Figure 7:
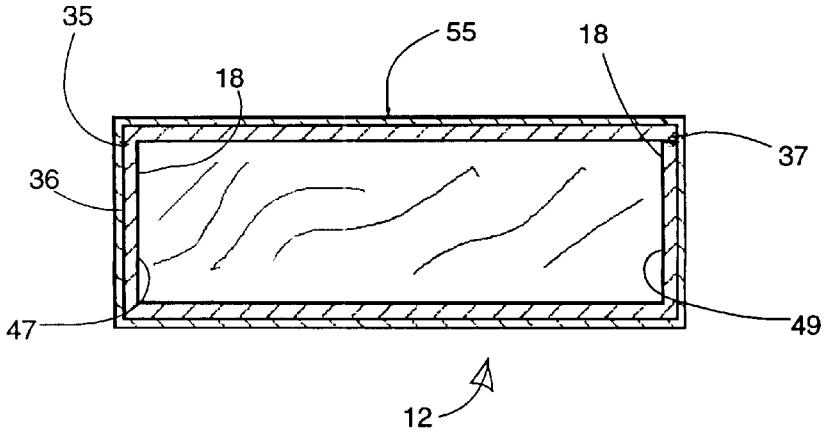
FIG. 7 is an enlarged cross sectional view taken along the line 7—7 in FIG. 5.

The drawing illustrates preferred embodiments of compressed fabric packages in accord with this invention that can be made to simulate rectangular products selected from the group consisting of books and video cassettes the embodiment of FIGS. 3–11 shows how a fabric article can be made into a package 12 that simulates a book, and the embodiment of FIGS. 11–14 shows how a fabric article can be made into a package 13 that simulates a video cassette. FIG. 1 shows a fabric t-shirt 10 having indicia or visible material 11 printed on it. FIG. 2 shows the t-shirt 10 after it has been compressed by any known conventional method into the shape of a rectangular prism 14.

In the book embodiment illustrated in FIGS. 3–11, the prism 14 will have six rectangular sides that have predetermined length, width and thickness dimensions that simulate or approximate the corresponding dimensions of a rectangular book. Preferably the book being simulated will be a paperback or hardback book having a length of about five to seven inches, a width of about four to five inches and a thickness of about one half to two inches. The book being simulated will have a conventional front cover, back cover and spine, with the spine connecting the front and back covers. Both covers and the spine of the book being simulated will commonly have visible writing, pictures and designs printed thereon.

In the book embodiment, the prism 14 will have a pair of opposed identical first sides 15 that have a length 16 that approximates the length of the simulated book, Each of the first sides will have a width 17 that approximates the width of the simulated book. The prism 14 will have a pair of opposed identical second sides 18. Each of the second sides has a length that is the same as the length 16 that approximates the length of the simulated book, and each second side will have a width 19 that approximates the thickness of the simulated book. The prism 14 will have a pair of opposed identical third sides 20. Each of the third sides will have a length that is the same as the width 17 which approximates the width of the simulated book, and each third side will have a width that is the same as the thickness 19 which approximates the thickness of the simulated book. The first sides 15 will be the largest sides of prism 14.

In the embodiment shown in FIGS. 3–7, the prism 14 will be completely enclosed in a six sided folded overlay 30. The overlay 30 is unitary in that it is made from a single piece of opaque paper or cardboard. Overlay 30 has a flat rectangular first panel 31 that has an outside surface 32 that is constructed, decorated and arranged to resemble the front cover of the simulated book. Overlay 30 has a flat rectangular second panel 33 that has an outside surface 34 that is constructed, decorated and arranged to resemble the back cover of the simulated book. The first panel 31 and second panel 33 each have essentially the same or slightly larger length and width dimensions as the dimensions 16 and 17 of the first sides 15 of prism 14. Overlay 30 has a flat rectangular third panel 35 that has an outside surface 36 that is constructed, decorated and arranged to resemble the spine of the simulated book. The third panel 35 has essentially the same or slightly larger length and width dimensions as the dimensions 16 and 19 of one of said second sides 18 of prism 14. Third panel 35 connects the first and second panels. Overlay 30 has a flat, rectangular fourth panel 37 that has printing on an outside surface 38 that resembles the front edges of pages of the simulated book. The fourth panel is opposite to, and the same size as, the third panel 35. Overlay 30 has a flat, rectangular fifth panel 40 that has printing on its outside surface 41 that resembles the top edges of pages of the simulated book. Overlay 30 has a flat, rectangular sixth panel 42 that has printing on its outside surface 43 that resembles the bottom edges of pages of the simulated book. The fifth and sixth panels are opposite to each other, and each panel 40 and 42 has the same or slightly larger length and width dimensions as the dimensions 17 and 19 of the third sides 20 of prism 14. Visible writing, pictures and designs of the kind found on the covers and spine of the simulated book may be printed on the outside surfaces 32, 34 and 36 of the overlay 30, and some of visible material 11 printed on t-shirt 10 also may be printed on one or more of these panels.

The compressed fabric prism 14 is completely enclosed within the folded overlay 30. One of the first sides 15 is in contact with an inside surface 45 of the first panel 31 that is opposite to its outside surface 32. The other first side 15 is in contact with an inside surface 46 of second panel 33 that is opposite to its outside surface 34. One of the second sides 18 of prism 14 is in contact with an inside surface 47 of the third panel 35 that is opposite to its outside surface 36. The other second side 18 of prism 14 is in contact with an inside surface 49 of the fourth panel 37 that is opposite to its outside surface 38. One of the third sides 20 of prism 14 is in contact with an inside surface 50 of fifth panel 40 that is opposite to its outside surface 41. The other third side 20 is in contact with an inside surface 51 of the sixth panel 42 that is opposite to its outside surface 43.

A thin transparent plastic film 55 is shrink wrapped around the overlay 30 and the enclosed compressed fabric prism 14. This completely envelopes the overlay 30 in a sealing membrane that holds the package 12 together.

Figure 8:
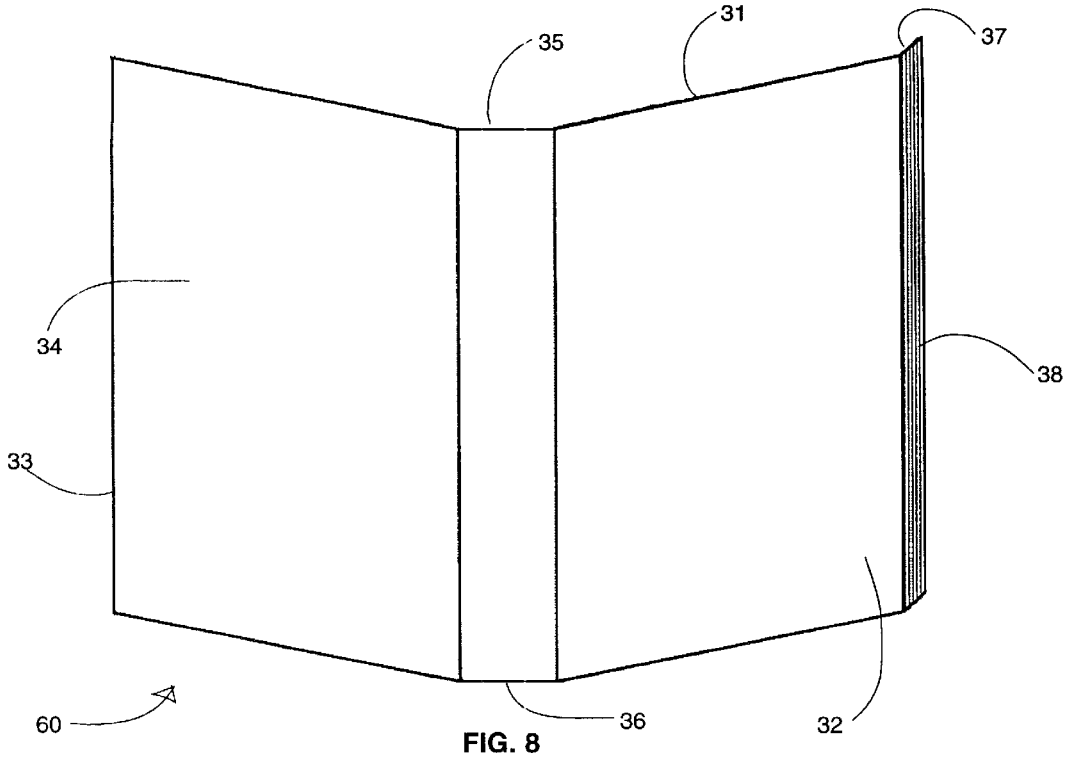
FIG. 8 is a schematic perspective view of the overlay from another embodiment of the invention.

FIG. 8 shows another embodiment of the invention in which the four sided overlay 60 is essentially identical to the overlay 30, except that the fifth and sixth sides 40 and 42 of overlay 30 have been omitted. In the book package simulated by this embodiment, the compressed fabric prism 14 would be enclosed within of the folded panels 31, 33, 35 and 37. The inside surfaces 45, 46, 47 and 49 of the panels 31, 33, 35 and 37 would contact the first and second sides 15 and 18 of the prism 14, and the entire package 12 would be enveloped in a shrink wrapped membrane 55, as described above. The third sides 20 of prism 14 would be visible through the membrane 55.

Figure 9:
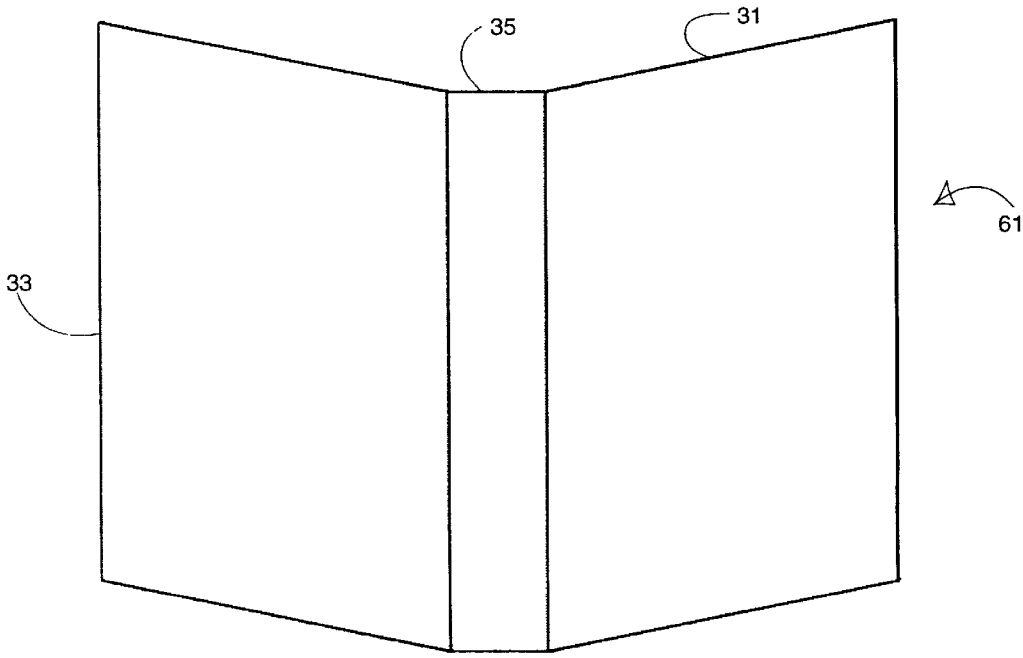
FIG. 9 is a schematic perspective view of the overlay from another embodiment of the invention.

FIG. 9 shows another embodiment of the invention in which the three sided overlay 61 is essentially identical to the overlay 30, except that the fourth, fifth and sixth sides 38, 40 and 42 have been omitted. In the book package simulated by this embodiment, the compressed fabric prism 14 would be enclosed within the folded panels 31, 33 and 35. The inside surfaces 45. 46 and 47 of the panels 31, 33 and 35 would contact the first sides 15 of the prism 14 and one of the sides 18, and the entire package would be enveloped in a shrink wrapped membrane 55, as described above. The the other side 18 and the third sides 20 of prism 14 would be visible through the membrane 55.

Figure 10:
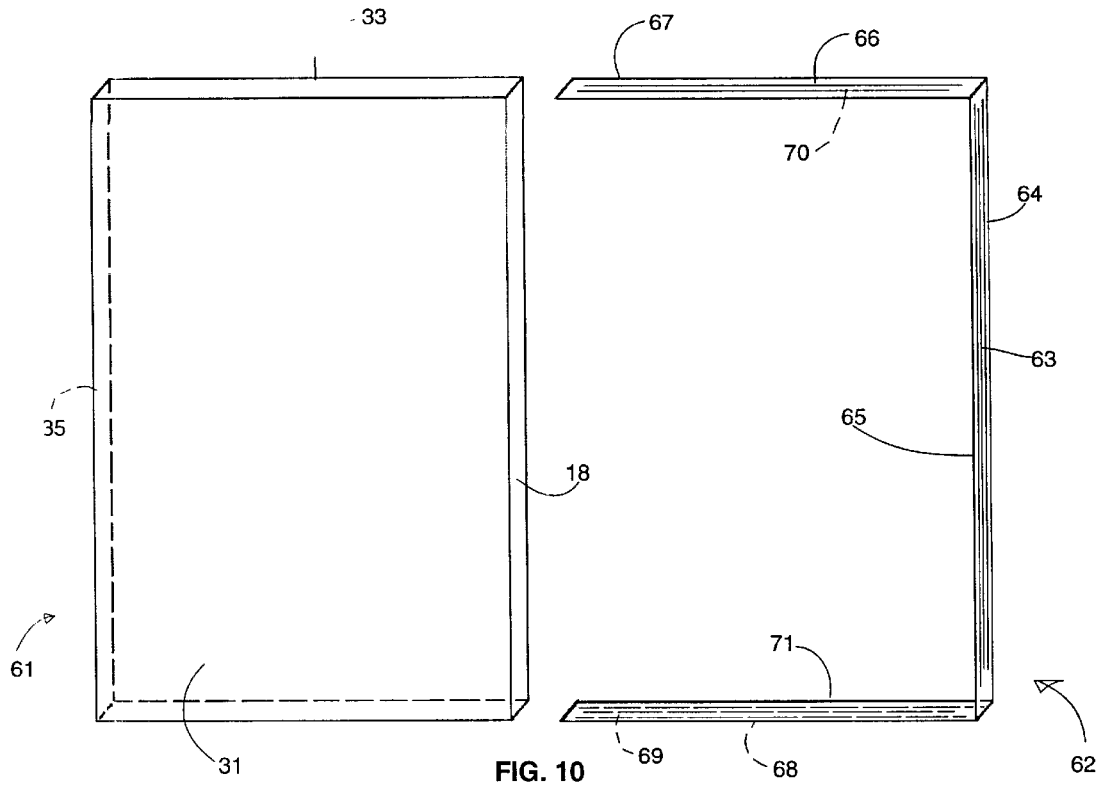
FIG. 10 is a schematic perspective exploded view of the overlay from another embodiment of the invention.

FIG. 10 shows another embodiment that is essentially identical to the embodiment of FIG. 9, except that a separate second overlay 62 is employed to cover and enclose the third sides 18 and the uncovered side 15 of the compressed fabric prism 14. Overlay 62 is unitary in that it is made from a single piece of folded opaque paper or cardboard that has printing resembling the edges of the pages of the simulated book. Second overlay 62 has a flat rectangular end panel 63 that has printing on an outside surface 64 that causes end panel 63 to resemble the front edges of pages of the simulated book. End panel 63 has essentially the same length and width dimensions as the dimensions 16 and 19 of the second sides 18 of prism 14. In the completed package, end panel 63 is opposite to the third panel 35 of overlay 61. An opposite inside surface 65 of end panel 63 would be in contact with the previously uncovered other second side 18. Second overlay 62 has a flat rectangular top panel 66 that has printing on an outside surface 67 that causes top panel 66 to resemble top edges of pages of the simulated book. Second overlay 62 has a flat rectangular bottom panel 68 that has printing on an outside surface 69 that causes bottom panel 68 to resemble bottom edges of pages of the simulated book. Top and bottom panels 66 and 68 are opposite to each other and each has essentially the same length and width dimensions 17 and 19 as each of the third sides 20 of prism 14. In the assembled package, an opposite inside surface 70 of top panel 66 would be in contact with one of the third sides 20 of the compressed fabric prism 14, and an opposite inside surface 71 of bottom panel 68 is in contact with the other of the third sides 20 of the prism. End panel 63 connects the top and bottom panels. The entire package 12 would be enveloped in a shrink wrapped membrane 55, as previously described.

FIGS. 11–14 show another embodiment in which package 13 resembles a video cassette tape. In this embodiment the compressed fabric prism 14 has six rectangular sides that have predetermined length, width and thickness dimensions that simulate or approximate the corresponding dimensions of a rectangular boxed VHS video tape. Preferably the tape box being simulated will have a length of about seven to eight inches, a width of about four to five inches, and a thickness of about one to two inches. The tape box being simulated will have a conventional front cover, a back cover, one open end, and three closed ends. The box will commonly have visible writing, pictures and designs printed thereon.

The fabric article 10 that has been compressed as shown in FIG. 2 into the shape of a rectangular prism that has six rectangular sides with the length, width and thickness dimensions that approximate the dimensions of the simulated video boxed cassette. In this embodiment prism 14 will have a pair of opposed identical first sides 15 with each first side 15 having a length 16 that approximates the length of the simulated video cassette box, and each first side having a width 17 that approximates the width of the simulated video cassette box. Prism 14 will have a pair of opposed identical second sides 18 with each second side having a length 16 that approximates the length of the simulated video cassette box, a width 19 that approximates the thickness of the simulated video cassette box. Prism 14 will have a pair of opposed identical third sides 20 with each third side having a length 17 that approximates the width of the simulated video cassette box and a width 19 that approximates the thickness of the video cassette box. The first sides 15 will be the largest sides of the rectangular prism.

Figure 11:
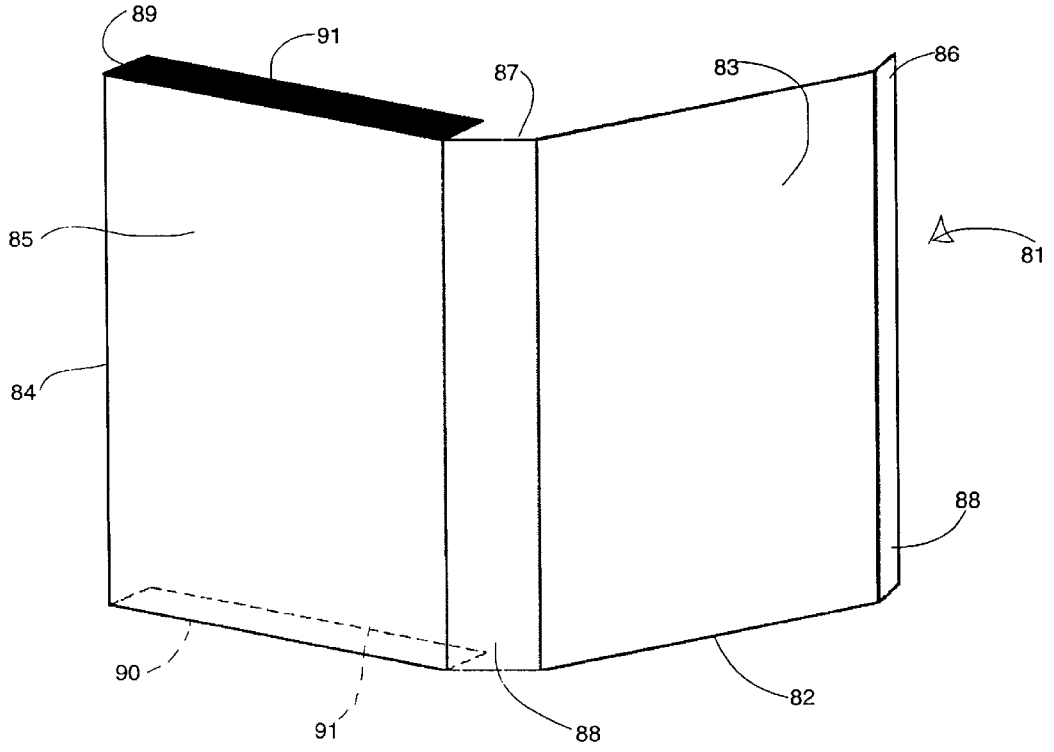
FIG. 11 is a schematic perspective view of the overlay from another embodiment of the invention.
Figure 12:
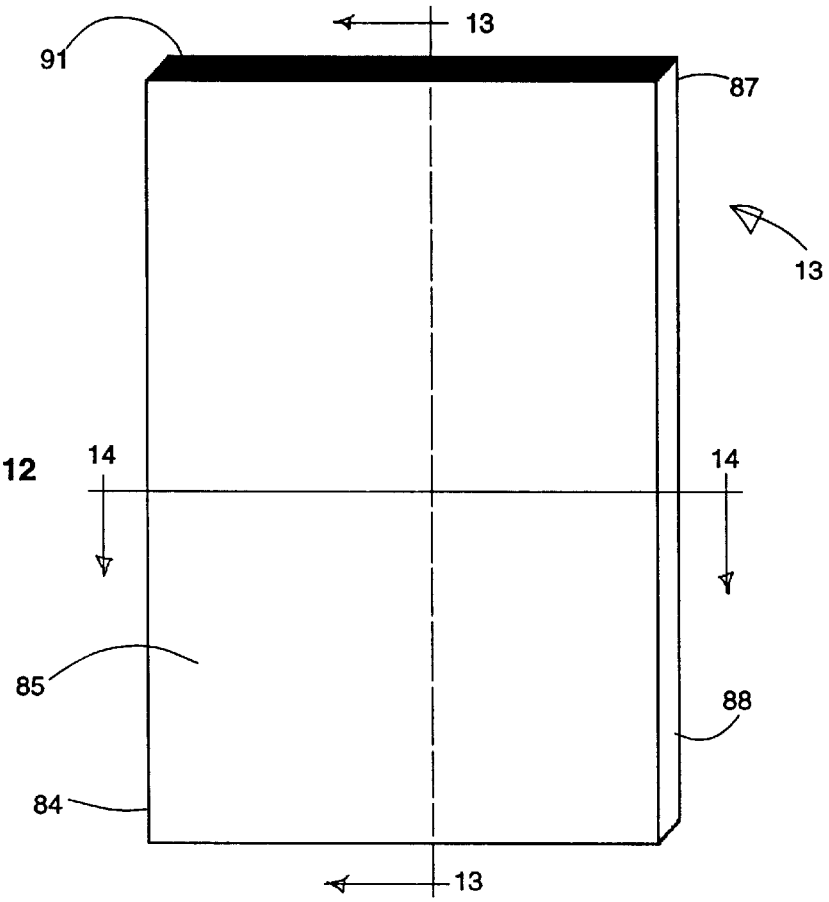
FIG. 12 is a schematic perspective view of the embodiment of of FIG. 11.
Figure 15:
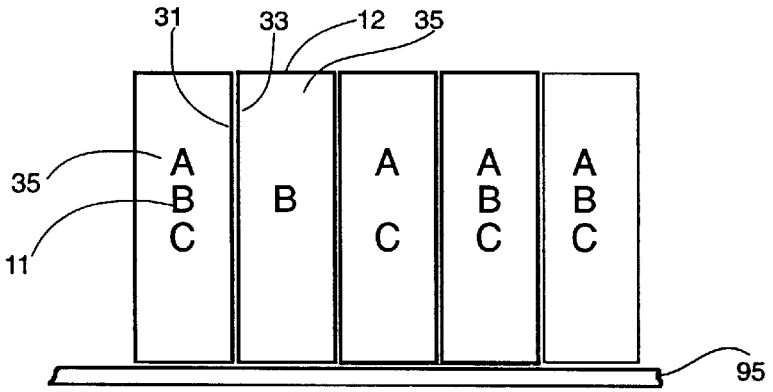
FIG. 15 is an end elevational view showing a method of displaying and selling packages in accord with this invention.
Figure 13:
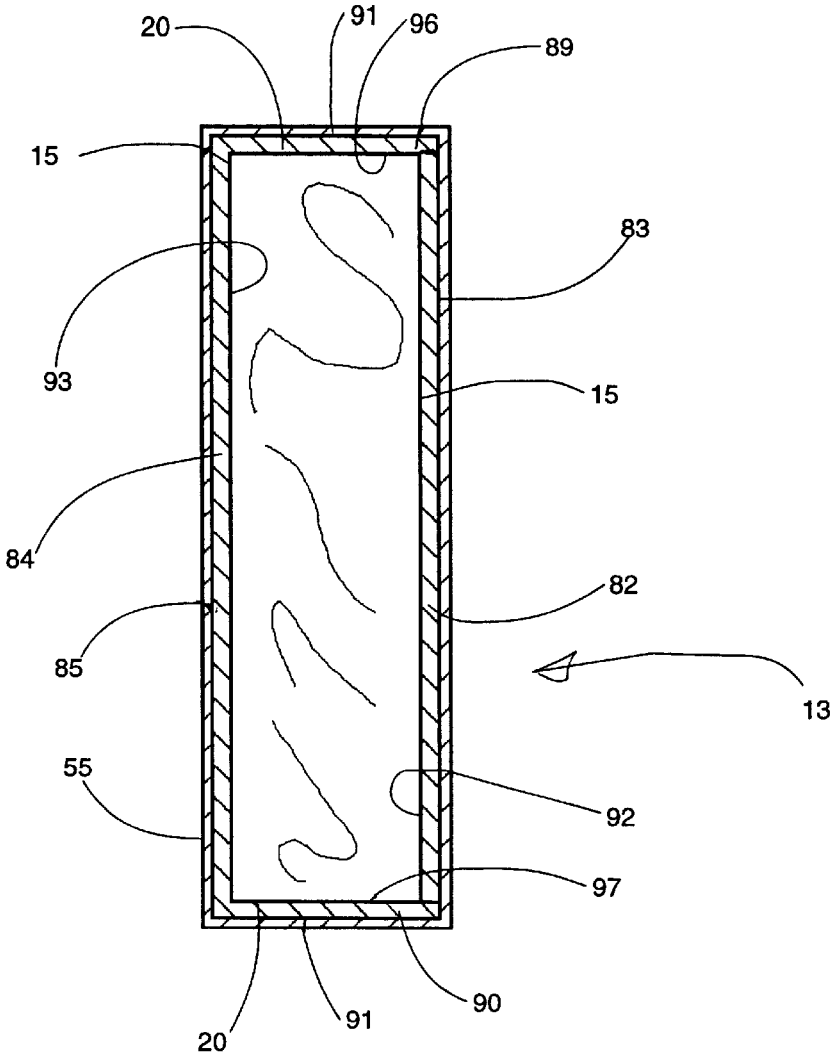
FIG. 13 is an enlarged cross sectional view taken along the line 13—13 in FIG. 12.
Figure 14:
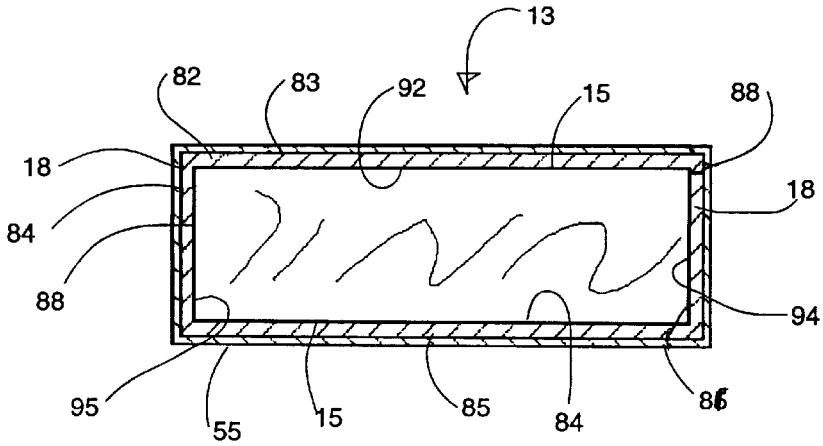
FIG. 14 is an enlarged cross sectional view taken along the line 14—14 in FIG. 12.

In the video cassette embodiment, the prism 14 will be completely enclosed in a six sided folded overlay 81. The overlay 81 is unitary in that it is made from a single piece of opaque paper or cardboard. Overlay 81 has a flat rectangular first panel 82 that has an outside surface 83 that is constructed, decorated and arranged to resemble the front cover of the simulated video cassette box. Overlay 30 has a flat rectangular second panel 84 that has an outside surface 85 that is constructed, decorated and arranged to resemble to resemble the back cover of the simulated video cassette box. The first and second panels of overlay 81 each have essentially the same or slightly larger length and width dimensions as the dimensions 16 and 17 as each of first sides 15 of prism 14. Overlay 81 has flat rectangular third and fourth panels 86 and 87, respectively, each of which has essentially the same or slightly larger length and width dimensions as the dimensions 16 and 19 of the second sides 18 of prism 14. The fourth panel 87 is opposite to the third panel 86. The third and fourth panels each have an outside surface 88 that is constructed decorated and arranged to resemble a side of the simulated video cassette box. Overlay 81 has integral, flat, rectangular fifth and sixth panels 89 and 90, respectively, each of which has essentially the same or slightly larger length and width dimensions as the dimensions 17 and 19 of the third sides 20 of prism 14. The fifth panel 89 is opposite to the sixth panel 90. The fifth and sixth panels each have an outside surface 91 that is constructed decorated and arranged to resemble a side of the simulated video cassette box. An exception may be made in decorating the simulated video box by having black or other solid colored printing on the outside surface of one of the third, fourth, fifth or sixth panels that makes the selected panel resemble an end or side of a plastic VHS video tape. In FIGS. 11 and 12 the outside surface 91 of the fifth panel 89 has been selected. Visible writing, pictures and designs of the kind commonly found on the outside of the simulated video cassette box may be printed on the rest of the outside surfaces 83, 85, 88 and 91 of the overlay 81, and some of visible material 11 printed on t-shirt 10 also may be printed on one or more of these panels.

The compressed fabric article prism 14 is completely enclosed within the folded overlay 81. One of the first sides 15 is in contact with an inside surface 92 of the first panel 82 that is opposite to its outside surface 83. The other first side 15 is in contact with an inside surface 93 of second panel 84 that is opposite to its outside surface 85. One of the second sides 18 of prism 14 is in contact with an inside surface 94 of the third panel 86 that is opposite to its outside surface 88. The other second side 18 of prism 14 is in contact with an inside surface 95 of the fourth panel 87 that is opposite to its outside surface 88. One of the third sides 20 of prism 14 is in contact with an inside surface 96 of fifth panel 89 that is opposite to its outside surface 91. The other third side 20 is in contact with an inside surface 97 of the sixth panel 90 that is opposite to its outside surface 91.

As in each of the previous embodiments, a thin transparent plastic film 55 would be shrink wrapped around the overlay 81 and the enclosed compressed fabric prism 14. This would completely envelope the overlay 81 in a sealing membrane that holds the package 13 together.

This invention also includes methods of packaging and displaying a plurality of fabric articles for sale. The fabric article 10 is first compressed into the shape of a rectangular prism 14 that has dimensions simulating corresponding dimensions of a book or a boxed video tape. The compressed fabric prism 14 can be completely enclosed in a decorative and protective overlay 30, 60, 61 or 62 that provides a package 12 that simulates a book, as described with reference to FIGS. 3–10. The compressed fabric prism 14 also can be completely enclosed in a decorative and protective overlay 81 that provides a package 13 that simulates a boxed video cassette, as described with reference to FIGS. 11–14 . A separate protective membrane 55 can then completely envelope and seal each of the individual overlays and its enclosed fabric prism 14. This produces separate sealed packages, each of which resembles a book or boxed video tape.

Several of the packages 12 or 13 can be supported on a horizontal surface of a type used to display the simulated product for sale, such as a flat book shelf 95. The individual packages 12 or 13 can be positioned in contact with each other other on the horizontal surface 95 so that first and second panels (e.g. 31 and 33) of the overlays (e.g. 30) of adjacent packages (e.g. 12) face each other and are obscured by each other, and the third panel (e.g. 35) of the overlay of each package is visible in a manner in which a part of the simulated product is normally visible when displayed for sale. Material that is commonly printed on the outside surface of a book or VHS video cassette box can be printed on an outside surface of one or more of the panels of the overlay. When the compressed fabric article 10 has visible material 11 printed on it, as shown in FIG. 1, at least some of such printed material 11 can be printed on the panel (e.g. 35) of the overlay that is visible in the display. When the package simulates a video cassette box, one of the panels (e.g. 91) of the overlay can have solid printing that resembles a side or end of a plastic video cassette.

While the present invention has been described with reference to particular preferred embodiments and methods, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

I claim:

1. A package that resembles a rectangular book having predetermined height, width and thickness dimensions, said book having a front cover, a back cover and a spine, said spine connecting said front and back covers, said package comprising:

a fabric article that has been compressed into the shape of a rectangular prism having six rectangular sides that have length, width and thickness dimensions that approximate the dimensions of said book, said prism having a pair of opposed identical first sides, each first side having a length that approximates the height of said book, and each first side having a width that approximates the width of said book, said prism having a pair of opposed identical second sides, each second side having a length that approximates said height of said book, and each second side having a width that approximates the thickness of said book, said prism having a pair of opposed identical third sides, each third side having a length that approximates the width of said book, and each third side having a width that approximates the thickness of said book, and said first sides being the largest sides of said rectangular prism;

an opaque, unitary, folded overlay comprising a flat rectangular first panel having an outside surface that causes said first panel to resemble the front cover of said book, said overlay having a flat rectangular second panel having an outside surface that causes said second panel to resemble the back cover of said book, said first and second panels of said overlay each having essentially the same dimensions as each of first sides of said prism, said overlay having a flat rectangular third panel having an outside surface that causes said third panel to resemble the spine of said book, said third panel of said overlay having essentially the same dimensions as one of said second sides of said prism, and said third panel connecting said first and second panels;

said compressed fabric article being enclosed within said folded overlay with one of said pair of first sides of said prism being in contact with an inside surface of said first panel of said overlay that is opposite to said outside surface of said first panel, the other of said pair of first sides of said prism being in contact with an inside surface of said second panel that is opposite to said outside surface of said second panel, and one of said second sides of said prism being in contact with an inside surface of said third panel that is opposite to said outside surface of said third panel; and a membrane of transparent plastic film completely enveloping and sealing around said fabric article and said overlay.

2. The package that resembles a rectangular book defined in claim 1, further comprising: said overlay comprising an integral, flat, rectangular fourth panel having printing on an outside surface thereof resembling front edges of pages of said book, said fourth panel being opposite to said third panel, and an opposite inside surface of said fourth panel being in contact with an other of said second sides of said prism.

3. The package that resembles a rectangular book defined in claim 2, further comprising: said overlay comprising an integral, flat, rectangular fifth panel having printing on an outside surface thereof resembling top edges of pages of said book, and an integral, flat, rectangular sixth panel having printing on an outside surface thereof resembling bottom edges of pages of said book, said fifth and sixth panels being opposite to each other, an opposite inside surface of said fifth panel being in contact with one of said third sides of said prism, and an opposite inside surface of said sixth panel being in contact with an other of said third sides of said prism.

4. The package that resembles a rectangular book defined in claim 1, further comprising: a separate, opaque, unitary, folded second overlay comprising a flat rectangular end panel having printing on an outside surface thereof that causes said end panel to resemble the front edges of pages of said book, said end panel of said second overlay having essentially the same dimensions as each of said second sides of said prism, said end panel being opposite to said third panel, and an opposite inside surface of said end panel being in contact with an other of said second sides of said prism, said second overlay having a flat rectangular top panel having printing on one surface thereof that causes said top panel to resemble top edges of pages of said book, said second overlay having a flat rectangular bottom panel having printing on an outside surface thereof that causes said bottom panel to resemble bottom edges of pages of said book, said top and bottom panels of said overlay being opposite to each other and each having essentially the same dimensions as each of third sides of said prism, an opposite inside surface of said top panel being in contact with one of said third sides of said prism, and an opposite inside surface of said bottom panel being in contact with an other of said third sides of said prism, and said end panel connecting said top and bottom panels.

5. The package that resembles a rectangular book defined in claim 1, further comprising: said overlay having printing visible on the outside surface of at least one of its panels.

6. The package that resembles a rectangular book defined in claim 5, further comprising: said first panel having printing on its outside surface that causes said first panel to resemble the front cover of said book, said second panel having printing on its outside surface that causes said second panel to resemble the back cover of said book, and said third panel having printing on its outside surface that causes said third panel to resemble the spine of said book.

7. The package that resembles a rectangular book defined in claim 1, further comprising: said compressed fabric article having printing thereon, and said overlay having at least some of said printing visible on at least one of its outside surfaces.

8. A package that resembles a boxed, rectangular VHS, video cassette having predetermined height, width and thickness dimensions, the box for said video cassette having a front cover, a back cover, one open end, and three closed ends, said package comprising:

a fabric article that has been compressed into the shape of a rectangular prism having six rectangular sides that have length, width and height dimensions that approximate the dimensions of said video cassette box, said prism having a pair of opposed identical first sides, each first side having a length that approximates the height of said video cassette box, and each first side having a width that approximates the width of said video cassette box, said prism having a pair of opposed identical second sides, each second side having a length that approximates said height of said video cassette box, and each second side having a width that approximates the thickness of said video cassette box, said prism having a pair of opposed identical third sides, each third side having a length that approximates the width of said video cassette box, and each third side having a width that approximates the thickness of said video cassette box, and said first sides being the largest sides of said rectangular prism;

an opaque, unitary, folded overlay comprising a flat rectangular first panel having printing on an outside surface thereof that causes said first panel to resemble the front cover of said video cassette box, said overlay having a flat rectangular second panel having printing on an outside surface thereof that causes said second panel to resemble the back cover of said video cassette box, said first and second panels of said overlay each having essentially the same dimensions as each of first sides of said prism, said overlay having a flat rectangular third and fourth panels each having essentially the same dimensions as one of said second sides of said prism, said fourth panel being opposite to said third panel, said overlay having an integral, flat, rectangular fifth and sixth panels each having essentially the same dimensions as one of said third sides of said prism, said fifth and sixth panels being opposite to each other;

said compressed fabric article being enclosed within said folded overlay with one of said pair of first sides of said prism being in contact with an inside surface of said first panel of said overlay that is opposite to said outside surface of said first panel, the other of said pair of first sides of said prism being in contact with an inside surface of said second panel that is opposite to said outside surface of said second panel, one of said second sides of said prism being in contact with an inside surface of said third panel, and an other of said second sides of said prism being in contact with an inside surface of said fourth panel, one of said third sides of said prism being in contact with an inside surface of said fifth panel, and an other of said third sides of said prism being in contact with an inside surface of said sixth panel; and a membrane of transparent plastic film completely enveloping and sealing around said fabric article and said overlay.

9. The package that resembles a boxed, rectangular VHS, video cassette defined in claim 8, in which all except one of said third, fourth fifth and sixth panels having printing on an outside surface thereof resembling printing on said video cassette box, and said one panel has printing on an outside surface thereof resembling a surface of said video cassette.

10. The package that resembles a boxed, rectangular VHS, video cassette defined in claim 9, in which said one panel is either of said fifth and sixth panels.

11. The package that resembles a boxed, rectangular VHS, video cassette defined in claim 9, in which said one panel is either of said third and fourth panels.

12. The package that resembles a boxed, rectangular VHS, video cassette defined in claim 8, further comprising: said compressed fabric article having printing thereon, and said overlay having at least some of said printing visible on at least one of its outside surfaces.

13. A method of packaging and displaying a plurality of fabric articles for sale, comprising:

compressing each of said fabric articles into a separate compact rectangular prism having six rectangular sides that have length, width and thickness dimensions approximating corresponding dimensions of a rectangular product selected from the group consisting of books and boxed VHS video cassettes;

providing for each of said fabric articles a folded overlay comprising a flat rectangular first panel having an outside surface that causes said first panel to resemble a front cover of said product, said overlay having a flat rectangular second panel having an outside surface that causes said second panel to resemble a back cover of said product, said first and second panels of said overlay each having essentially the same dimensions as a pair of opposite sides of said prism, said overlay having a flat rectangular third panel having an outside surface that causes said third panel to resemble a side of said product between said front and back covers that is connected to said front and back covers, said third panel of said overlay having essentially the same dimensions as another side of said prism, and said third panel connecting said first and second panels;

enclosing each of the compressed fabric article prisms within one of said folded overlays so that one of said pair of opposite sides of said prism contacts an inside surface of said first panel of said overlay that is opposite to said outside surface of said first panel, and the other of said pair of opposite sides of said prism contacts an inside surface of said second panel that is opposite to said outside surface of said second panel, and said another side of said prism contacts an inside surface of said third panel that is opposite to said outside surface of said third panel;

completely enveloping and sealing a separate membrane of transparent plastic film around each of said overlays and its enclosed compressed fabric article prism so as to provide a separate package resembling said product;

supporting a plurality of said packages on a horizontal surface of a type used to display said product for sale; and positioning a plurality of said packages in contact with each other other on said horizontal surface so that first and second panels of the overlays of adjacent packages face each other and are obscured by each other, and the third panel of the overlay of each package is visible in a manner in which a part of said product is normally visible when displayed for sale.

14. The method of packaging and displaying a plurality of fabric articles for sale defined in claim 13, further comprising:

printing visible material on said compressed fabric article, and printing at least some of said visible material on at least one of the outside surfaces of a panel said overlay.

15. The method of packaging and displaying a plurality of fabric articles for sale defined in claim 14, in which at least some of said visible material is printed on said third panel of said overlay.

16. The method of packaging and displaying a plurality of fabric articles for sale defined in claim 13, further comprising:

printing visible material on an outside surface of a panel of said overlay that resembles material visible on an outside surface of a book.

17. The method of packaging and displaying a plurality of fabric articles for sale defined in claim 16, further comprising:

printing the material that is visible on the outside surface of said panel on said third panel of said overlay.

18. The method of packaging and displaying a plurality of fabric articles for sale defined in claim 13, further comprising:

printing visible material on an outside surface of a panel of said overlay that resembles material visible on an outside surface of a VHS video cassette box.

19. The method of packaging and displaying a plurality of fabric articles for sale defined in claim 18, further comprising:

providing said overlay with an other panel and printing visible material on an outside surface of the other panel of said overlay that resembles a side of a video cassette.

20. A package that resembles a rectangular book having predetermined height, width and thickness dimensions, said book having a front cover, a back cover and a spine, said spine connecting said front and back covers, said package comprising:

a fabric article having the general shape of a prism that approximates the shape of said book, said prism having a pair of opposed first sides, each first side having a length that approximates the height of said book, and each first side having a width that approximates the width of said book, said prism having a pair of opposed second sides, each second side having a length that approximates said height of said book, and each second side having a width that approximates the thickness of said book, said prism having a pair of opposed third sides, each third side having a length that approximates the width of said book, and each third side having a width that approximates the thickness of said book, and said first sides being the largest sides of said prism, said fabric article having printing thereon;

an opaque, unitary, folded overlay comprising a flat rectangular first panel having an outside surface with printing thereon that causes said first panel to resemble the front cover of said book, said overlay having a flat rectangular second panel having an outside surface with printing thereon that causes said second panel to resemble the back cover of said book, said first and second panels of said overlay each having the general dimensions of each of first sides of said prism, said overlay having a flat rectangular third panel having an outside surface with printing thereon that causes said third panel to resemble the spine of said book, said third panel of said overlay having the general dimensions of one of said second sides of said prism, said third panel connecting said first and second panels, and said overlay having at least some of the printing that is on said fabric article visibly printed on at least one of its outside surfaces;

said fabric article being enclosed within said folded overlay with at least one of the sides of said prism being in contact with an inside surface of one of said panels of said overlay that is opposite to the outside surface of said one panel; and a membrane of transparent plastic film completely enveloping and sealing around said fabric article and said overlay.

21. A package that resembles a boxed, rectangular VHS, video cassette having predetermined height, width and thickness dimensions, the box for said video cassette having a front cover, a back cover, one open end, and three closed ends, said package comprising:

a fabric article having the general shape of a prism that approximates the shape of said video cassette box, said prism having a pair of opposed first sides, each first side having a length that approximates the height of said video cassette box, and each first side having a width that approximates the width of said video cassette box, said prism having a pair of opposed second sides, each second side having a length that approximates said height of said video cassette box, and each second side having a width that approximates the thickness of said video cassette box, said prism having a pair of opposed third sides, each third side having a length that approximates the width of said video cassette box, and each third side having a width that approximates the thickness of said video cassette box, and said first sides being the largest sides of said prism;

an opaque, unitary, folded overlay comprising a flat rectangular first panel having printing on an outside surface thereof that causes said first panel to resemble the front cover of said video cassette box, said overlay having a flat rectangular second panel having printing on an outside surface thereof that causes said second panel to resemble the back cover of said video cassette box, said first and second panels of said overlay each having the general dimensions of the first sides of said prism, said overlay having a flat rectangular third and fourth panels each having the general dimensions of one of said second sides of said prism, said fourth panel being opposite to said third panel, said overlay having integral, flat, rectangular fifth and sixth panels each having the general dimensions as one of said third sides of said prism, said fifth and sixth panels being opposite to each other;

said fabric article being enclosed within said folded overlay with at least one of said sides of said prism being in contact with an inside surface of one of said panels of said overlay that is opposite to said outside surface of said one panel; and a membrane of transparent plastic film completely enveloping and sealing around said fabric article and said overlay.

22. The package that resembles a rectangular book defined in claim 20, further comprising: said overlay comprising an integral, flat, rectangular fourth panel having printing on an outside surface thereof resembling front edges of pages of said book, said fourth panel being opposite to said third panel.

23. The package that resembles a rectangular book defined in claim 22, further comprising: said overlay comprising an integral, flat, rectangular fifth panel having printing on an outside surface thereof resembling top edges of pages of said book, and an integral, flat, rectangular sixth panel having printing on an outside surface thereof resembling bottom edges of pages of said book, said fifth and sixth panels being opposite to each other.

24. The package that resembles a rectangular book defined in claim 20, further comprising: a separate, opaque, unitary, folded second overlay comprising a flat rectangular end panel having printing on an outside surface thereof that causes said end panel to resemble the front edges of pages of said book, said end panel of said second overlay having essentially the same dimensions as each of said second sides of said prism, said end panel being opposite to said third panel, said second overlay having a flat rectangular top panel having printing on one surface thereof that causes said top panel to resemble top edges of pages of said book, said second overlay having a flat rectangular bottom panel having printing on an outside surface thereof that causes said bottom panel to resemble bottom edges of pages of said book, said top and bottom panels of said overlay being opposite to each other and each having essentially the same dimensions as each of third sides of said prism, and said end panel connecting said top and bottom panels.

25. The package that resembles a boxed, rectangular VHS, video cassette defined in claim 21, in which all except one of said third, fourth, fifth and sixth panels having printing on an outside surface thereof resembling printing on said video cassette box, and said one panel has printing on an outside surface thereof resembling a surface of said video cassette.

26. The package that resembles a boxed, rectangular VHS, video cassette defined in claim 21, further comprising: said fabric article having printing thereon, and said overlay having at least some of said printing visible on at least one of its outside surfaces.

* * * * *